US009970655B2

(12) United States Patent
Paller et al.

(10) Patent No.: US 9,970,655 B2
(45) Date of Patent: May 15, 2018

(54) OVEN APPLIANCE

(71) Applicant: General Electric Company, Schenectady, NY (US)

(72) Inventors: Hans Juergen Paller, Louisville, KY (US); Justin Patrick Todd, Louisville, KY (US)

(73) Assignee: Haier US Appliance Solutions, Inc, Wilmington, DE (US)

( * ) Notice: Subject to any disclaimer, the term of this patent is extended or adjusted under 35 U.S.C. 154(b) by 382 days.

(21) Appl. No.: 14/800,825

(22) Filed: Jul. 16, 2015

(65) Prior Publication Data

US 2017/0016617 A1 Jan. 19, 2017

(51) Int. Cl.

| | |
|---|---|
| ***F23D 14/10*** | (2006.01) |
| ***F24C 3/08*** | (2006.01) |
| ***F24C 3/00*** | (2006.01) |

(52) U.S. Cl.

CPC ..... *F23D 14/10* (2013.01); *F24C 3/087* (2013.01)

(58) Field of Classification Search

CPC .. F23D 14/10; F24C 3/087; F24C 3/08; F24C 3/06; F24C 15/36; F24C 15/027

USPC ..... 126/39 E, 19 R, 39 D, 41 R, 39 B

See application file for complete search history.

(56) References Cited

U.S. PATENT DOCUMENTS

| | | | | |
|---|---|---|---|---|
| 979,413 | A | 12/1910 | Best | |
| 2,164,147 | A | 6/1939 | Schneider | |
| 5,816,234 | A * | 10/1998 | Vasan | F24C 15/322 126/21 A |
| 2003/0205223 | A1* | 11/2003 | Schlosser | F23D 14/10 126/41 R |
| 2011/0139142 | A1 | 6/2011 | Schalueck | |
| 2013/0239945 | A1* | 9/2013 | Han | F24C 3/087 126/41 R |

FOREIGN PATENT DOCUMENTS

| | | | | |
|---|---|---|---|---|
| GB | 194225 A * | 3/1923 | ..... | F24C 3/087 |

* cited by examiner

*Primary Examiner* — Avinash Savani
*Assistant Examiner* — Rabeeul Zuberi
(74) *Attorney, Agent, or Firm* — Dority & Manning, P.A.

(57) ABSTRACT

An oven appliance with a cabinet having a cooking chamber is provided. A floor panel is positioned within the cabinet at the cooking chamber. A gas burner includes a tube. The tube is bent such that a first elongated portion of the tube is positioned below the floor panel at a first side portion of the floor panel and a second elongated portion of the tube is positioned below the floor panel at a front portion of the floor panel.

16 Claims, 4 Drawing Sheets

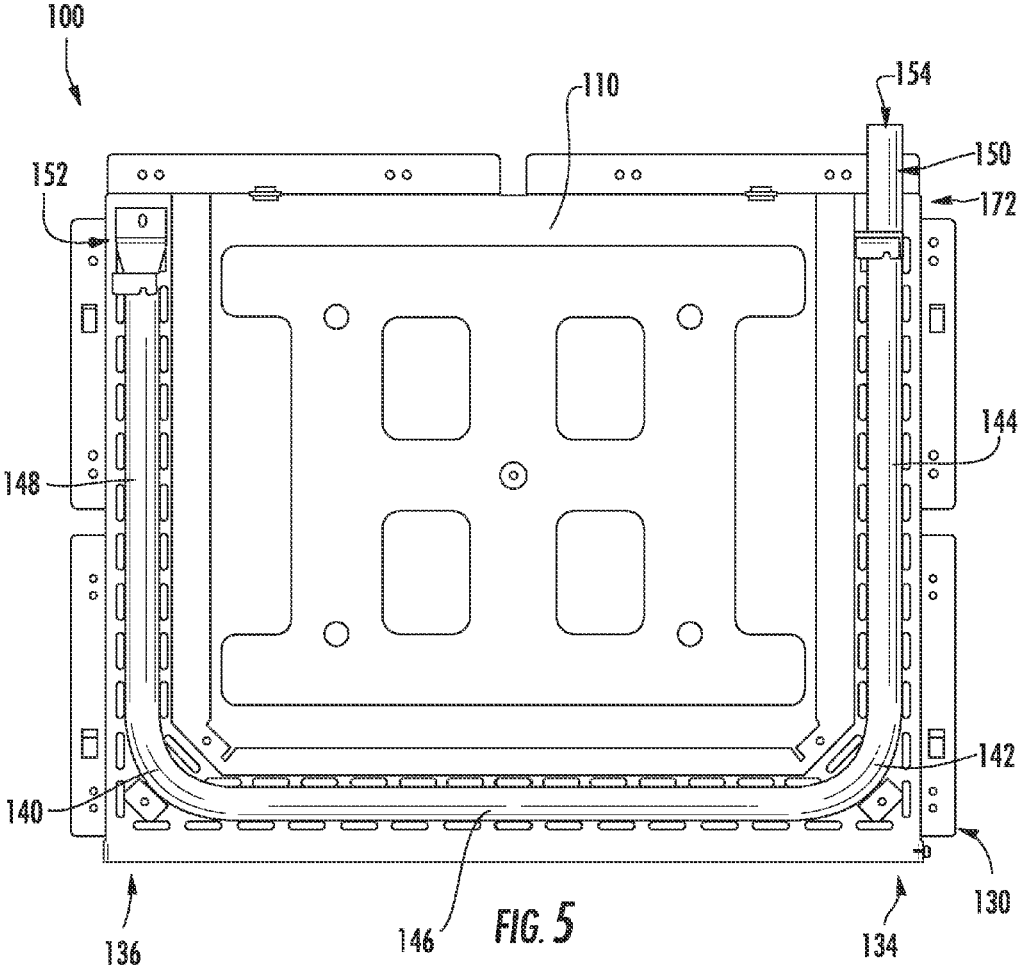
FIG. 5
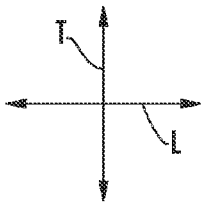

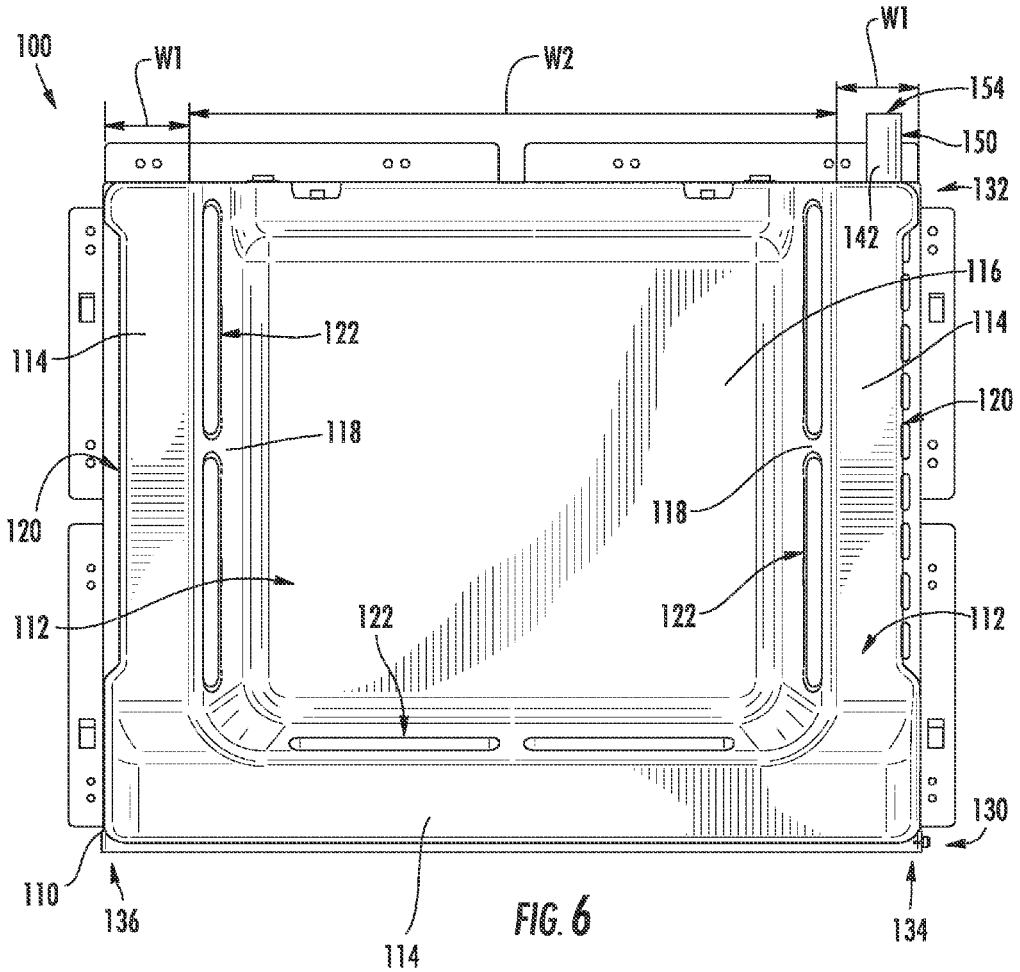
FIG. 6
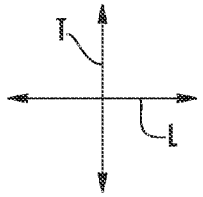

OVEN APPLIANCE

FIELD OF THE INVENTION

The present subject matter relates generally to oven appliances and burners for oven appliances.

BACKGROUND OF THE INVENTION

Oven appliances generally include a cabinet with a cooking chamber. One or more heating elements cook food items within the cooking chamber. In gas oven appliances, the heating elements may include a gas bake burner positioned at a bottom of the cooking chamber. Certain gas bake burners are formed as straight tubular gas burners. Straight tubular gas burners are generally oriented such that the burners run fore to aft and are centered left to right within the cabinet under the cooking chamber.

Straight tubular gas burners have drawbacks. For example, straight tubular gas burners can occupy a large volume of space below the cooking chamber and thereby reduce the potential size of the cooking chamber. As another example, a flow pattern of heated air generated by combusting gaseous fuel at a center of the cooking chamber and exhausting heated air at a perimeter of the cooking chamber can cause a floor panel of the oven appliance to get very hot, e.g., approximately thirteen hundred degrees Fahrenheit during a self-clean cycle. Such high temperatures can cause several issues, including excessive radiant heat transfer upward into the cooking chamber which can negatively affect baking performance; degradation of oven appliance components over time, such as corrosion of the straight tubular gas burner, warping and/or corrosion of a flame spreader, porcelain finish cracking, etc.; expensive floor insulation to limit heat transfer to flooring below the oven appliance; and temperature differences between front and rear portions of the cooking chamber which can negatively affect both baking and self-clean performance.

Accordingly, an oven appliance with features for heating a cooking chamber of the oven appliance while conserving valuable space below the cooking chamber would be useful. In addition, an oven appliance with features for heating a cooking chamber of the oven appliance while limiting unbalanced heating of a center of the cooking chamber would be useful.

BRIEF DESCRIPTION OF THE INVENTION

The present subject matter provides an oven appliance with a cabinet having a cooking chamber. A floor panel is positioned within the cabinet at the cooking chamber. A gas burner includes a tube. The tube is bent such that a first elongated portion of the tube is positioned below the floor panel at a first side portion of the floor panel and a second elongated portion of the tube is positioned below the floor panel at a front portion of the floor panel. Additional aspects and advantages of the invention will be set forth in part in the following description, or may be apparent from the description, or may be learned through practice of the invention.

In one exemplary embodiment, an oven appliance defining a lateral direction and a transverse direction that are perpendicular to each other is provided. The oven appliance includes a cabinet having a cooking chamber. The cabinet defines an opening for accessing the cooking chamber of the cabinet. A pair of side walls is positioned within the cabinet at the cooking chamber. The side walls of the pair of side walls are positioned opposite each other about the cooking chamber. A floor panel is positioned within the cabinet at the cooking chamber. The floor panel extends between a front portion and a back portion along the transverse direction. The front portion of the floor panel is positioned adjacent the opening of cabinet. The floor panel also extends between a first side portion and a second side portion along the lateral direction. The first and second side portions of the floor panel are each positioned adjacent a respective one of the pair of side walls. A gas burner includes a tube. The tube is bent such that a first elongated portion of the tube is positioned below the floor panel at the first side portion of the floor panel and a second elongated portion of the tube is positioned below the floor panel at the front portion of the floor panel.

In a second exemplary embodiment, an oven appliance is provided. The oven appliance includes a cabinet having a cooking chamber. The cabinet defines an opening for accessing the cooking chamber. A door is mounted to the cabinet at the opening of the cabinet. A pair of side walls is positioned within the cabinet at the cooking chamber. The side walls of the pair of side walls are positioned opposite each other about the cooking chamber. A floor panel is positioned within the cabinet at the cooking chamber. A gas burner includes a tube. The tube is bent such that a first elongated portion of the tube is positioned below the floor panel adjacent a first one of the pair of side walls, a second elongated portion of the tube is positioned below the floor panel adjacent the opening of the cabinet, and a third elongated portion of the tube is positioned below the floor panel adjacent a second one of the pair of side walls.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 provides a bottom, plan view of the exemplary oven floor assembly of FIG. 3.

FIG. 6 provides a top, plan view of the exemplary oven floor assembly of FIG. 3.

DETAILED DESCRIPTION

Figure 1:
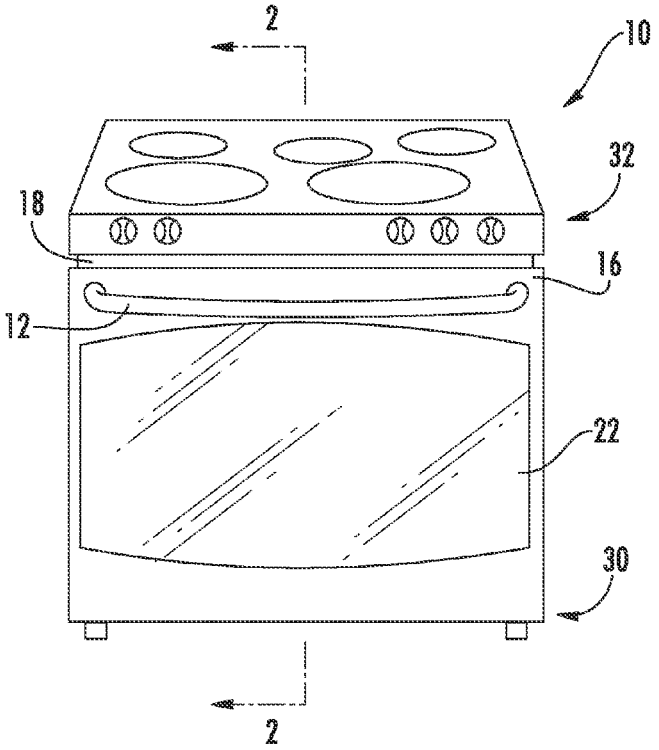
FIG. 1 provides a perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
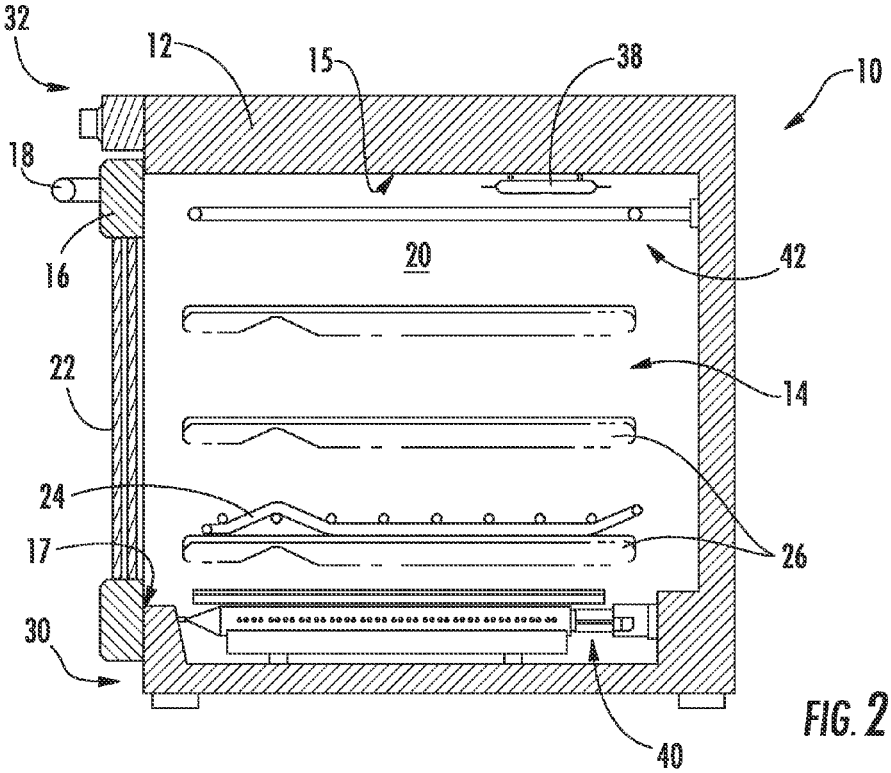
FIG. 2 provides a section view of the exemplary range appliance of FIG. 1 taken along the 2-2 line of FIG. 1.

FIG. 1 provides a perspective view of a range appliance 10 according to an exemplary embodiment of the present subject matter. FIG. 2 provides a section view of range appliance 10 taken along the 2-2 line of FIG. 1. Range appliance 10 is provided by way of example only and is not intended to limit the present subject matter in any aspect. Thus, the present subject matter may be used with other range appliance configurations, e.g., that define multiple interior cavities for the receipt of food and/or having different pan or rack arrangements than what is shown in FIG. 2, or standalone oven appliances.

Range appliance 10 includes an insulated cabinet 12 with an interior cooking chamber 14 defined by an interior surface 15 of cabinet 12. Cooking chamber 14 is configured for the receipt of one or more food items to be cooked. Cabinet 12 also defines an opening 17 at a front portion of cabinet 12. Opening 17 of cabinet 12 is positioned and sized such that opening 17 permits access to cooking chamber 14. A door 16 is rotatably mounted to cabinet 12, e.g., with a hinge (not shown), at opening 17. A handle 18 is mounted to door 16 and assists a user with opening and closing door 16 in order to access cooking chamber 14. For example, a user can pull on handle 18 to open or close door 16 and access cooking chamber 14.

Range appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open. As may be seen in FIG. 2, range appliance 10 includes a pair of side walls 20, e.g., that form at least a portion of embossed ribs or sliding rails 26 within cooking chamber 14. Only one of side walls 20 is shown in FIG. 2, but, as will be understood by those skilled in the art, side walls 20 may be positioned opposite each other within cooking chamber 14, e.g., such that side walls 20 are laterally spaced apart from each other.

A gas fueled, bottom heating element 40 (e.g., a gas burner or a bake gas burner) is positioned in cabinet 12, e.g., at a bottom portion 30 of cabinet 12. Bottom heating element 40 is used to heat cooking chamber 14 for both cooking and cleaning of range appliance 10. The size and heat output of bottom heating element 40 can be selected based on the e.g., the size of range appliance 10.

A top heating element 42 is also positioned in cooking chamber 14 of cabinet 12, e.g., at a top portion 32 of cabinet 12. Top heating element 42 is used to heat cooking chamber 14 for both cooking/broiling and cleaning of range appliance 10. Like bottom heating element 40, the size and heat output of top heating element 42 can be selected based on the e.g., the size of range appliance 10. In the exemplary embodiment shown in FIG. 2, top heating element 42 is shown as an electric resistance heating element. However, in alternative embodiments, a gas, microwave, halogen, or any other suitable heating element may be used instead of electric resistance heating element 42.

The operation of range appliance 10 including heating elements 40 and 42 is controlled by one or more processing devices (not shown) such as a microprocessor or other device that is in communication with such components. Such processing device (used herein to refer generally to single and/or multiple processing devices) is also in communication with a temperature sensor 38 that is used to measure temperature inside cooking chamber 14 and provide such measurements to the process device. Temperature sensor 38 is shown (in FIG. 2) in the top and rear of cooking chamber 14. However, other locations may be used and, if desired, multiple temperature sensors may be applied as well.

Figure 3:
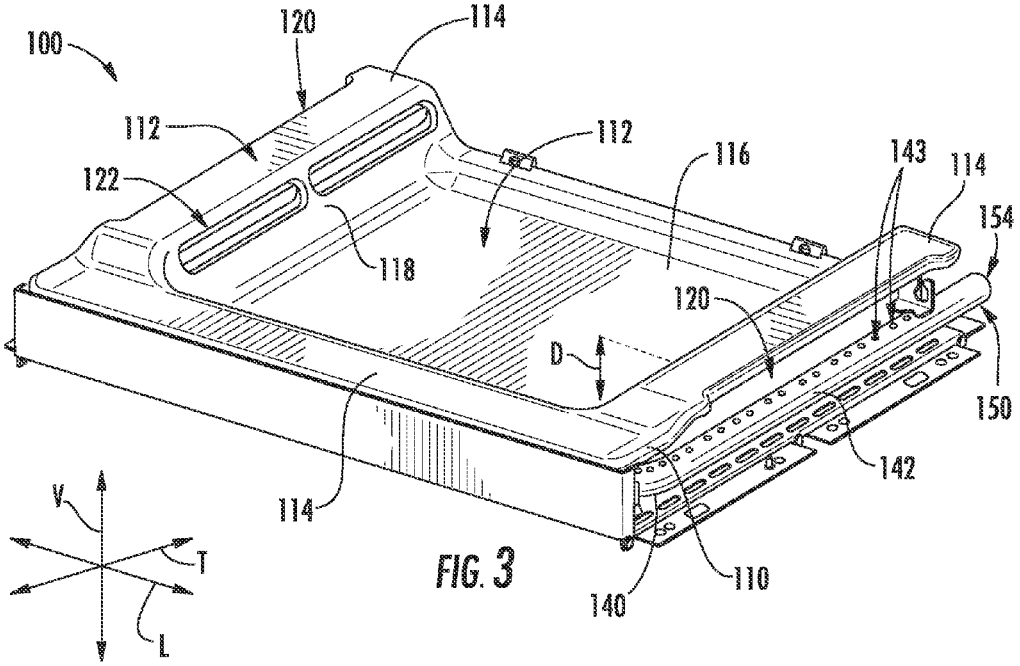
FIG. 3 provides a front, perspective view of an oven floor assembly according to an exemplary embodiment of the present subject matter.
Figure 4:
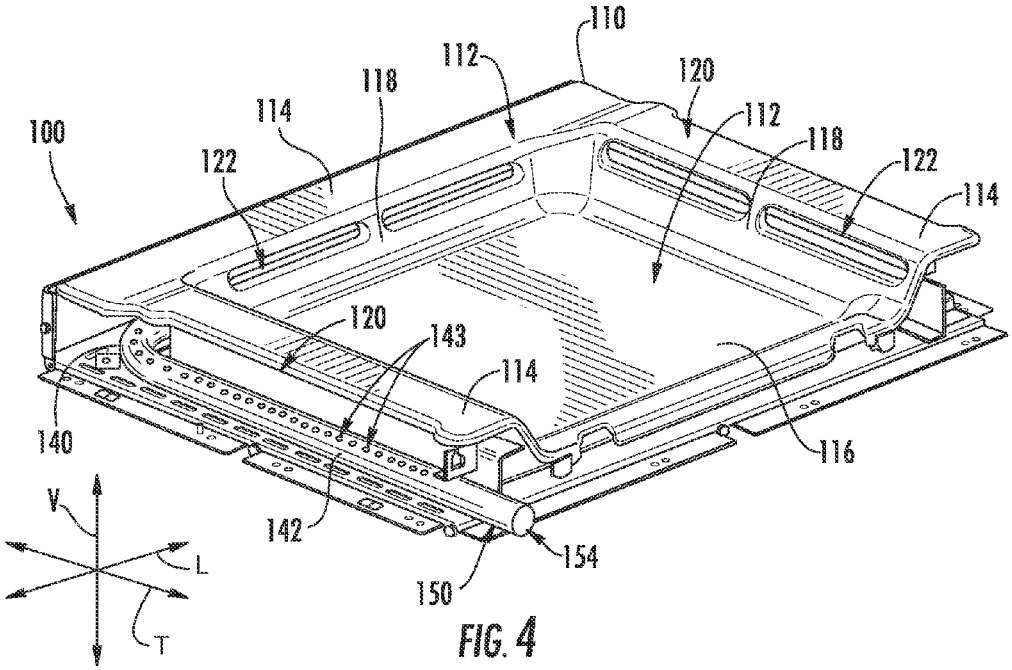
FIG. 4 provides a rear, perspective view of the exemplary oven floor assembly of FIG. 3.

FIG. 3 provides a front, perspective view of an oven floor assembly 100 according to an exemplary embodiment of the present subject matter. FIG. 4 provides a rear, perspective view of oven floor assembly 100. FIG. 5 provides a bottom, plan view of oven floor assembly 100. FIG. 6 provides a top, plan view of oven floor assembly 100. Oven floor assembly 100 is described in greater detail below in the context of range appliance 10 (FIG. 1). However, it should be understood that oven floor assembly 100 may be used in any other suitable oven appliance in alternative exemplary embodiments.

As may be seen in FIGS. 3 and 4, oven floor assembly 100 defines a vertical direction V, a lateral direction L and a transverse direction T. The vertical direction V, the lateral direction L and the transverse direction T are mutually perpendicular and form an orthogonal direction system. Oven floor assembly 100 includes a floor panel 110 and a gas burner 140 positioned below floor panel 110, e.g., along the vertical direction V. Floor panel 110 and gas burner 140 are discussed in greater detail below.

Floor panel 110 may be positioned within cabinet 12 at a bottom of cooking chamber 14. As may be seen in FIG. 6, floor panel 110 extends between a front portion 130 and a back portion 132, e.g., along the transverse direction T. The front portion 130 of floor panel 110 is positioned at or adjacent opening 17 of cabinet 12 and/or door 16. Back portion 130 of floor panel 110 is positioned opposite opening 17 of cabinet 12 within cooking chamber 14, e.g., at or adjacent a back wall of cabinet 12. Thus, front and back portions 130, 132 of floor panel 110 are spaced apart from each other and positioned at opposite ends of cooking chamber 14, e.g., along the transverse direction T.

Floor panel 110 also extends between a first side portion 134 and a second side portion 136, e.g., along the lateral direction L. The first and second side portions 134, 136 of floor panel 110 are each positioned adjacent a respective one of side walls 20. Thus, first and second side portions 134, 136 of floor panel 110 are spaced apart from each other and positioned at opposite ends of cooking chamber 14, e.g., along the lateral direction L.

Floor panel 110 may be formed of or with any suitable material. For example, floor panel 110 may be formed of or with a metal. In particular, floor panel 110 may be formed of or with a sheet of stamped metal, such as steel. As may be seen in FIG. 3, floor panel 110 may have a generally square or rectangular shape, e.g., in a plane that is perpendicular to the vertical direction V.

Gas burner 140 is positioned below floor panel 110 and is configured for heating air within cooking chamber 14 by combusting a suitable gaseous fuel, such as propane or natural gas. Gas burner 140 includes a tube 142. A flow of gaseous fuel and air within tube 142 may exit tube 142 at a plurality of holes 143 defined along a length of tube 142 and the flow of gaseous fuel and air may be combusted at holes 143 below floor panel 110. Holes 143 may be positioned or formed at a top of tube 142, as shown in FIGS. 3 and 4.

Tube 142 is bent such that tube 142 includes a first rectilinear or elongated portion 144, a second rectilinear or elongated potion 146 and a third rectilinear or elongated portion 148. As an example, tube 142 may be a single continuous piece of metal, such as a steel, copper or aluminum piping, bent to form the first, second and third elongated portions 144, 146 and 148 of tube 142. In particular, tube 142 may be bent such that tube 142 is U-shaped, e.g., in a plane that is perpendicular to the vertical direction V. Thus, the first, second and third elongated portions 144, 146 and 148 of tube 142 may be formed such that tube 142 is U-shaped, e.g., in a plane that is perpendicular to the vertical direction V, as shown in FIG. 5. In certain exemplary embodiments, tube 142 need not include third elongated portion 148.

First elongated portion 144 of tube 142 is positioned below floor panel 110, e.g., at or adjacent first side portion 134 of floor panel 110. Thus, first elongated portion 144 of tube 142 may be positioned below floor panel 110 at or adjacent a first one of side walls 20. Second elongated portion 146 of tube 142 is positioned below floor panel 110, e.g., at or adjacent front portion 130 of floor panel 110. Thus, second elongated portion 146 of tube 142 may be positioned below floor panel 110 at or adjacent opening 17 of cabinet 12, e.g., between side walls 20. Third elongated portion 148 of tube 142 is positioned below floor panel 110, e.g., at or adjacent second side portion 136 of floor panel 110. Thus, third elongated portion 148 of tube 142 may be positioned below floor panel 110 at or adjacent a second one of side walls 20. Combustion of gaseous fuel and air at holes 143 may more uniformly heat areas above the first, second and third elongated portions 144, 146 and 148 of tube 142 relative to conventional gas burners with straight burner tubes due to the distribution of the first, second and third elongated portions 144, 146 and 148 of tube 142 below cooking chamber 14.

Turning to FIG. 5, tube 142 extends, e.g., continuously, between a first end portion 150 and a second end portion 152. First end portion 150 of tube 142 may be positioned below floor panel 110 at or adjacent back portion 132 of floor panel 110 and at or adjacent first side portion 134 of floor panel 110. Conversely, second end portion 152 of tube 142 may be positioned below floor panel 110 at or adjacent back portion 132 of floor panel 110 and at or adjacent second side portion 136 of floor panel 110. Thus, first and second end portions 150, 152 of tube 142 may be spaced apart from each other along the lateral direction L.

First end portion 150 of tube 142 defines a gas inlet 154. Gas inlet 154 is configured for receiving a flow of gaseous fuel and air and directing the flow of gaseous fuel and air into tube 142. Thus, as will be understood by those skilled in the art, gas inlet 154 may include a suitable Venturi throat and/or shutter and may be coupled to a suitable fuel source, e.g., via an orifice. In the exemplary embodiment shown in FIGS. 3-6, second end portion 152 of tube 142 is crimped closed or shut. Thus, the flow of gaseous fuel and air within tube 142 is blocked from exiting tube 142 at second end portion 152 of tube 142. The flow of gaseous fuel and air within tube 142 may exit tube 142 at holes 143. Holes 143 may be, e.g., uniformly or evenly, distributed between the first and second end portions 150, 152 of tube 142 on the first, second and third elongated portions 144, 146 and 148 of tube 142.

As discussed above, second end portion 152 of tube 142 is crimped closed or shut in the exemplary embodiment shown in FIGS. 3-6. In alternative exemplary, embodiments, second end portion 152 of tube 142 may be open and define an additional gas inlet. The additional gas inlet may be construction in the same or similar manner to gas inlet 154. Thus, the additional gas inlet at second end portion 152 of tube 142 may be configured for receiving an additional flow of gaseous fuel and air and directing the additional flow of gaseous fuel and air into tube 142. In such exemplary embodiment, tube 142 may be fed gaseous fuel and air at both first and second end portions 150, 152 of tube 142.

As may be seen in FIGS. 3, 4 and 6, floor panel 110 has an outer surface 112. Outer surface 112 of floor panel 110 is positioned opposite or faces away from gas burner 140. Thus, outer surface 112 of floor panel 110 may face cooking chamber 14 within cabinet 12. Outer surface 112 of floor panel 110 may have any suitable shape. For example, as discussed in greater detail below, floor panel 110 may define a well or depression at a central portion of floor panel 110. Thus, an inner portion of outer surface 112 of floor panel 110 may be depressed relative to an outer portion of outer surface 112 of floor panel 110. Such shaping of floor panel 110 may assist with conserving valuable space within cooking chamber 14, as discussed in greater detail below.

As may be seen in FIGS. 3 and 4, outer surface 112 of floor panel 110 has a first planar portion 114 and a second planar portion 116. Tube 142 of gas burner 140 is positioned below first planar portion 114 of outer surface 112, e.g., along the vertical direction V. Second planar portion 116 of outer surface 112 is positioned below first planar portion 114 of outer surface 112, e.g., along the vertical direction V. Thus, second planar portion 116 of outer surface 112 may be recessed within cooking chamber 14 relative to first planar portion 114 of outer surface 112. In addition, tube 142 of gas burner 140 may be positioned coplanar with or above second planar portion 116 of outer surface 112, e.g., in a plane that is perpendicular to the vertical direction V, in certain exemplary embodiments.

First and second planar portions 114, 116 of outer surface 112 may have any suitable shape. For example, first planar portion 114 of outer surface 112 may be U-shaped, e.g., in a plane that is perpendicular to the vertical direction V. As another example, second planar portion 116 of outer surface 112 may be square or rectangular, e.g., in a plane that is perpendicular to the vertical direction V. First and second planar portions 114, 166 of outer surface 112 may also be spaced apart from each other, e.g., along the vertical direction V, by a height H. The height H may be any suitable height. For example, the height H may be no less than two inches, no less than three inches, no less than four inches, etc.

Floor panel 110 also includes a sidewall 118 that extends between and connects first and second planar portions 114, 116 of outer surface 112, e.g., along the vertical direction V. Sidewall 118 defines a plurality of vents 122. Vents 122 permit combustion gases from gas burner 140 to flow through floor panel 110 into cooking chamber 14. First planar portion 114 of outer surface 112 may also define a plurality of vents 120. Vents 120 may extend through floor panel 110, e.g., along the vertical direction V, and combustion gases from gas burner 140 to flow through vents 120 into cooking chamber 14. As shown in FIGS. 3 and 4, vents 120 may be at least partially defined by an edge of first planar portion 114 of outer surface 112. In particular, vents 120 may be defined between edges of first planar portion 114 of outer surface 112 and interior surface 15 of cooking chamber 14.

As may be seen in FIG. 6, first planar portion 114 of outer surface 112 defines a width W1, e.g., along the lateral direction L, at or adjacent back portion 132 of floor panel 110. First planar portion 114 of outer surface 112 includes two segments at back portion 132 of floor panel 110 in the exemplary embodiment shown in FIG. 6, and width W1 incorporates both segments. Second planar portion 116 of outer surface 112 (e.g., and sidewall 118 as shown in FIG. 6) also defines a width W2, e.g., along the lateral direction L, at or adjacent back portion 132 of floor panel 110. The width W2 of second planar portion 116 is greater than the width W1 of first planar portion 114. As an example, the width W2 of second planar portion 116 may be no less than twice the width W1 of first planar portion 114. As another example, the width W2 of second planar portion 116 may be no less than four times the width W1 of first planar portion 114.

As discussed above, floor panel 110 and gas burner 140 include various features for improving performance of range appliance 10. For example, floor panel 110 may increase a volume of cooking chamber 14 by at least fifteen percent relative to conventional floor panels with flat outer surfaces by recessing a central area of floor panel 110 away from gas burner 140. In addition, the position and/or shape of gas burner 140 may reduce a temperature of the center area of floor panel 110 relative to gas burners with straight burner tubes, and thereby: lower radiant heat transfer from floor panel 110 to food products cooking within cooking chamber 14 and/or flooring below range appliance 10; reduce thermal wear on materials of oven floor assembly 100; and/or reduce temperature differentials within cooking chamber 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction and a transverse direction that are perpendicular to each other, the oven appliance comprising:

a cabinet having a cooking chamber, the cabinet defining an opening for accessing the cooking chamber of the cabinet;

a pair of side walls positioned within the cabinet at the cooking chamber, the side walls of the pair of side walls positioned opposite each other about the cooking chamber;

a floor panel positioned within the cabinet at the cooking chamber, the floor panel extending between a front portion and a back portion along the transverse direction, the front portion of the floor panel positioned adjacent the opening of the cabinet, the floor panel also extending between a first side portion and a second side portion along the lateral direction, the first and second side portions of the floor panel each positioned adjacent a respective one of the walls of the pair of side walls;

a gas burner comprising a tube, the tube bent such that a first elongated portion of the tube is positioned below the floor panel at the first side portion of the floor panel and a second elongated portion of the tube is positioned below the floor panel at the front portion of the floor panel;

wherein the tube is bent such that the tube is U-shaped; and wherein the floor panel has an outer surface that faces the cooking chamber, the outer surface of the floor panel having a first planar portion; and a second planar portion, the first planar portion is positioned against the pair of side walls, the tube of the gas burner positioned below the first planar portion of the outer surface of the floor panel, the second planar portion of the outer surface of the floor panel positioned below the first planar portion of the outer surface of the floor panel.

2. The oven appliance of claim 1, wherein a third elongated portion of the tube is positioned below the floor panel at the second side portion of the floor panel.

3. The oven appliance of claim 1, wherein the tube is a single, continuous piece of metal.

4. The oven appliance of claim 1, wherein the tube extends between a first end portion and a second end portion, the first end portion of the tube defining a gas inlet, the first end portion of the tube positioned below the floor panel at the back portion of the floor panel and adjacent the first side portion of the floor panel.

5. The oven appliance of claim 4, wherein the second end portion of the tube is crimped closed.

6. The oven appliance of claim 1, wherein the first and second planar portions of the outer surface of the floor panel are spaced apart from each other along a vertical direction by no less than two inches.

7. The oven appliance of claim 1, wherein the first planar portion of the outer surface of the floor panel defines a plurality of vents, each vent of the plurality of vents extending between the outer surface of the floor panel and an inner surface of the floor panel.

8. The oven appliance of claim 1, wherein the floor panel comprises a sidewall that extends between and connects the first and second planar portions of the outer surface of the floor panel.

9. The oven appliance of claim 8, wherein the sidewall of the floor panel defines a plurality of vents that extends through the sidewall of the floor panel.

10. An oven appliance, comprising:

a cabinet having a cooking chamber, the cabinet defining an opening for accessing the cooking chamber;

a door mounted to the cabinet at the opening of the cabinet;

a pair of side walls positioned within the cabinet at the cooking chamber, the side walls of the pair of side walls positioned opposite each other about the cooking chamber;

a floor panel positioned within the cabinet at the cooking chamber;

a gas burner comprising a tube, the tube bent such that the tube is U-shaped and such that a first elongated portion of the tube is positioned below the floor panel adjacent a first wall one of the pair of side walls, a second elongated portion of the tube is positioned below the floor panel adjacent the opening of the cabinet, and a third elongated portion of the tube is positioned below the floor panel adjacent a second wall of the pair of side walls;

wherein the floor panel has an outer surface that faces the cooking chamber, the outer surface of the floor panel having a first planar portion and a second planar portion, the first planar portion is positioned against the pair of side walls, the tube of the gas burner positioned below the first, planar portion of the outer surface of the floor panel, the second planar portion of the outer surface of the floor panel positioned below the first planar portion of the outer surface of the floor panel.

11. The oven appliance of claim 10, wherein the tube extends between a first end portion and a second end portion, the first end portion of the tube defining a gas inlet, the first end portion of the tube positioned below the floor panel adjacent a back portion of the cooking chamber and the first one of the pair of side walls.

12. The oven appliance of claim 11, wherein the second end portion of the tube is crimped closed.

13. The oven appliance of claim 8, wherein the first and second planar portions of the outer surface of the floor panel are spaced apart from each other along a vertical direction by no less than two inches.

14. The oven appliance of claim 13, wherein the first planar portion of the outer surface of the floor panel defines a plurality of vents, each vent of the plurality of vents extending between the outer surface of the floor panel and an inner surface of the floor panel.

15. The oven appliance of claim 13, wherein the floor panel comprises a sidewall that extends between and connects the first and second planar portions of the outer surface of the floor panel, the sidewall of the floor panel defining a plurality of vents that extends through the sidewall of the floor panel.

16. An oven appliance defining a lateral direction and a transverse direction that are perpendicular to each other, the oven appliance comprising:

a cabinet having a cooking chamber, the cabinet defining an opening for accessing the cooking chamber of the cabinet;

a pair of side walls positioned within the cabinet at the cooking chamber, the side walls of the pair of side walls positioned opposite each other about the cooking chamber;

a floor panel positioned within the cabinet at the cooking chamber, the floor panel extending between a front portion and a back portion along the transverse direction, the front portion of the floor panel positioned adjacent the opening of the cabinet, the floor panel also extending between a first side portion and a second side portion along the lateral direction, the first and second side portions of the floor panel each positioned adjacent a respective one of the walls of the pair of side walls;

a gas burner comprising a tube, the tube bent such that a first elongated portion of the tube is positioned below the floor panel at the first side portion of the floor panel and a second elongated portion of the tube is positioned below the floor panel at the front portion of the floor panel;

wherein the tube is bent such that the tube is U-shaped; and wherein the floor panel has an outer surface that faces the cooking chamber, the outer surface of the floor panel having a first planar portion and a second planar portion, the first planar portion is positioned against the pair of side walls such that first planar portion is U-shaped, the tube of the gas burner positioned below the first planar portion of the outer surface of the floor panel, the second planar portion of the outer surface of the floor panel positioned below the first planar portion of the outer surface of the floor panel.

* * * * *